US008887830B2

(12) United States Patent
Heichel et al.

(10) Patent No.: US 8,887,830 B2
(45) Date of Patent: Nov. 18, 2014

(54) TELESCOPING LEADER

(75) Inventors: Christian Heichel, Niedernberg (DE); Albrecht Kleibl, Schaafsheim (DE)

(73) Assignee: ABI Anlagentechnik-Baumaschinen-Industriebedarf Maschinenfabrik und Vertriebsgesellschaft mbH, Niedernberg (DE)

( * ) Notice: Subject to any disclaimer, the term of this patent is extended or adjusted under 35 U.S.C. 154(b) by 425 days.

(21) Appl. No.: 12/928,725

(22) Filed: Dec. 17, 2010

(65) Prior Publication Data

US 2011/0168421 A1 Jul. 14, 2011

(30) Foreign Application Priority Data

Jan. 14, 2010 (EP) ..... 10000289

(51) Int. Cl.
*E21B 7/02* (2006.01)
*E02D 7/16* (2006.01)
*E21B 15/00* (2006.01)

(52) U.S. Cl.
CPC . *E02D 7/16* (2013.01); *E21B 15/00* (2013.01); *E21B 7/023* (2013.01)
USPC ..... 173/184

(58) Field of Classification Search
USPC ..... 173/184–189, 24–28, 39–42, 44, 173/190–196, 45, 141, 213
See application file for complete search history.

(56) References Cited

U.S. PATENT DOCUMENTS 3,753,468 A * 8/1973 Casagrande ..... 173/44
4,035,969 A * 7/1977 Casagrande ..... 52/111
5,114,109 A * 5/1992 Fitz et al. ..... 248/404
7,640,998 B2 * 1/2010 Howell, Jr. ..... 173/184
7,870,911 B2 * 1/2011 Yoshida et al. ..... 173/185
8,397,833 B2 * 3/2013 Stoetzer et al. ..... 173/157
8,672,036 B2 * 3/2014 Hughes et al. ..... 166/332.2
2002/0050112 A1 * 5/2002 Koch et al. ..... 52/651.07
2008/0217037 A1 * 9/2008 Howell ..... 173/28
2009/0133891 A1 * 5/2009 Yoshida et al. ..... 173/193
2009/0314547 A1 12/2009 Stoetzer et al.
2010/0012340 A1 * 1/2010 Kuosmanen ..... 173/184

FOREIGN PATENT DOCUMENTS

DE 1 784 590 8/1971
DE 26 45 071 4/1978
DE 10 2005 060 740 7/2007

(Continued)

OTHER PUBLICATIONS

European Search Report dated Jun. 16, 2010 with English translation.
Information from European Patent Office regarding examination dated Jun. 24, 2010 with English translation of the relevant parts.

(Continued)

*Primary Examiner* — Robert Long
(74) *Attorney, Agent, or Firm* — Collard & Roe, P.C.

(57) ABSTRACT

A telescoping leader for a construction vehicle for accommodating a vibrator, pile driver, earth drilling gear mechanism, or the like, has an outer leader that is disposed so that it can be longitudinally displaced relative to an inner leader. The inner leader and outer leader have closed material cross-sections, and the outer leader surrounds the inner leader. At the end of the outer leader that can be displaced on the inner leader, and at the end of the inner leader that is guided in the outer leader, a guide is firmly disposed, on which the outer leader can be displaced.

9 Claims, 5 Drawing Sheets

(56) References Cited

FOREIGN PATENT DOCUMENTS

| | | |
|---|---|---|
| DE | 20 2008 014 827 | 2/2009 |
| EP | 0 114 146 | 7/1984 |
| EP | 0 548 900 | 6/1993 |
| EP | 2 133 508 | 12/2009 |
| FR | 2 744 489 | 8/1997 |
| JP | 9-217349 | 8/1997 |

* cited by examiner

TELESCOPING LEADER

CROSS REFERENCE TO RELATED APPLICATIONS

Applicants claim priority under 35 U.S.C. §119 of European Application No. 10000289.8 filed Jan. 14, 2010.

BACKGROUND OF THE INVENTION

1. Field of the Invention

The invention relates to a telescoping leader for a construction vehicle, for accommodating a vibrator, a pile driver, an earth drilling gear mechanism, or the like.

2. The Prior Art

In the sector of civil engineering, devices of this type are generally known. They serve for driving in or also pulling out pilings, sheet pile walls, pile foundations, or the like, or also for introducing earth bores. For this purpose, the work device, for example a vibrator, is displaceably disposed on the leader, and the leader is used to press a sheet pile wall, for example, into the ground, in a vertical position, and to drive it in to the desired depth. The maximal depth that can be reached this way is determined by the length of the sheet pile wall, and this in turn requires the use of a leader having a sufficient length.

Since the length of the leader should be as short as possible to facilitate transport between the individual construction sites, the use of telescoping leaders has been known for a long time; these leaders are adjustable in their spatial position and attached to a construction vehicle, whereby this term should be broadly understood, in the sense of the invention, since it is supposed to comprise not only road vehicles such as wheeled earth movers or caterpillar earth movers, but also rail vehicles and, for the construction of water structures, also floating bodies, such as pontoons, for example. Fundamentally, the known telescoping leader consists of an outer and an inner leader, which are disposed concentrically or offset relative to one another, and can be displaced relative to one another using hydraulic cylinders or other linear drives. This structure makes it possible to extend the telescoping leader to its maximal height for work use, and to collapse it for transport. Torsion stresses and bending stresses are exerted on the outer leader by the work device, for example a vibrator with a pile-driving profile attached to it, and these stresses are introduced into the construction vehicle by connecting parts.

The disadvantage of the previously known telescoping leaders is that they are very heavy, as the result of open material cross-sections of the inner or outer leader, or an offset arrangement of the inner and outer leader, at the required bending resistance and torsion resistance. As a result, the useful height of the known leaders is restricted.

SUMMARY OF THE INVENTION

It is therefore an object of the invention to provide a telescoping leader, the bending resistance and torsion resistance of which is increased, at the same weight and the same construction size. The invention provides a telescoping leader in which the bending resistance and torsion resistance is increased as compared with the state of the art, at the same weight and the same construction size. The invention comprises an outer leader that is disposed so that it can be longitudinally displaced relative to an inner leader. The outer and inner leader have closed material cross-sections, and the outer leader surrounds the inner leader. A guide is firmly disposed at the end of the outer leader that is guided on the inner leader, in which guide the inner leader can be displaced. A guide is firmly disposed at the end of the inner leader that is guided in the outer leader, on which guide the outer leader can be displaced. The inner and outer leaders each have closed cross sections.

In a further development of the invention, the inner leader and outer leader are connected with an intermediate leader, in which the outer leader is guided so that it can be displaced. The intermediate leader preferably has an accommodation by way of which the intermediate leader is firmly connected with the inner leader. Because the outer leader is guided by the inner leader and the intermediate leader at the same time, the moments that act on the outer leader by the work device are distributed onto the inner and intermediate leader. In this way, uniform placement of stress on the outer and inner leader is brought about.

In a further development of the invention, the inner leader can be displaced relative to the outer leader by at least one linear drive. Preferably, a drive having a winch, gear rack, rack and pinion gearing, or a thread can be provided as the linear drive. It is advantageous if a hydraulic cylinder is disposed on its end of the inner leader that faces the outer leader. In this connection, a hydraulic cylinder is preferably additionally disposed at its end of the inner leader that faces the accommodation of the intermediate leader. Due to the placement of two hydraulic cylinders disposed one behind the other, the use of hydraulic cylinders having small dimensions is possible. The hydraulic cylinder that faces the outer leader can be dimensioned to be smaller than the hydraulic cylinder disposed on the inner leader. Also, a uniform placement of stress on the two cylinders is possible because of the serial circuit of two hydraulic cylinders.

In a further embodiment of the invention, the intermediate leader is connected with a leader connection plate, by means of which the telescoping leader can be coupled with a construction vehicle. In this way, simple coupling of the telescoping leader to a construction vehicle is made possible.

Preferably, the intermediate leader is guided on the leader connection plate so that it can be displaced. In this way, a telescoping arrangement of the leader, to telescope in multiple ways, is achieved. Preferably at least one hydraulic cylinder is provided, by means of which the intermediate leader can be displaced relative to the connection plate.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE EMBODIMENTS

Figure 1:
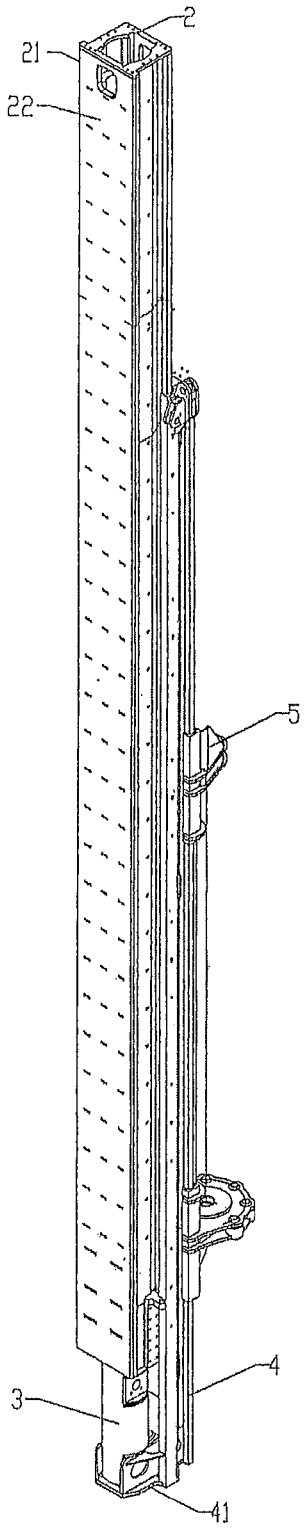
FIG. 1 shows a spatial representation of a telescoping leader.
Figure 2:
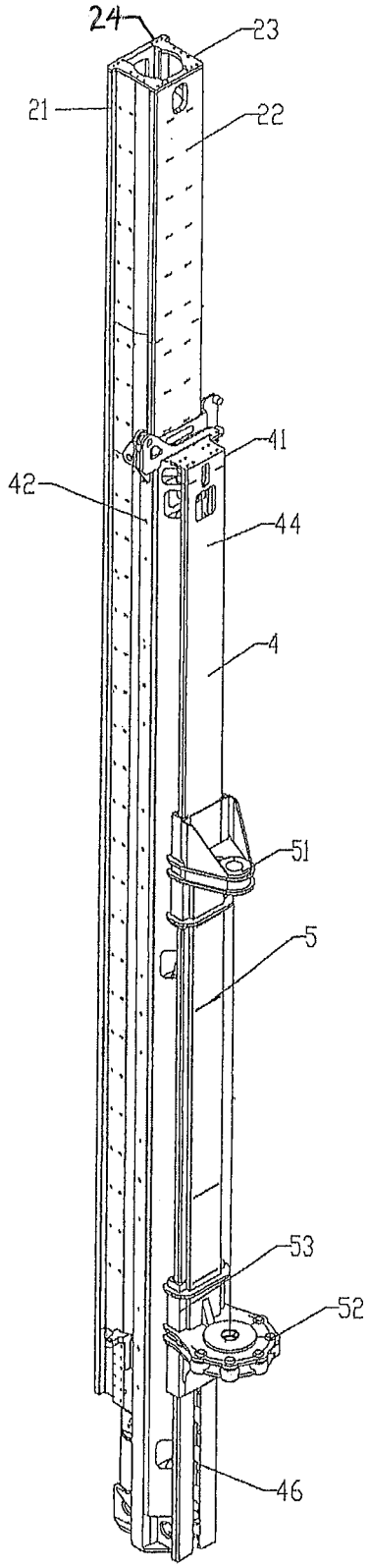
FIG. 2 shows the spatial representation of the telescoping leader from FIG. 1 from a perspective offset by 90·.
Figure 3:
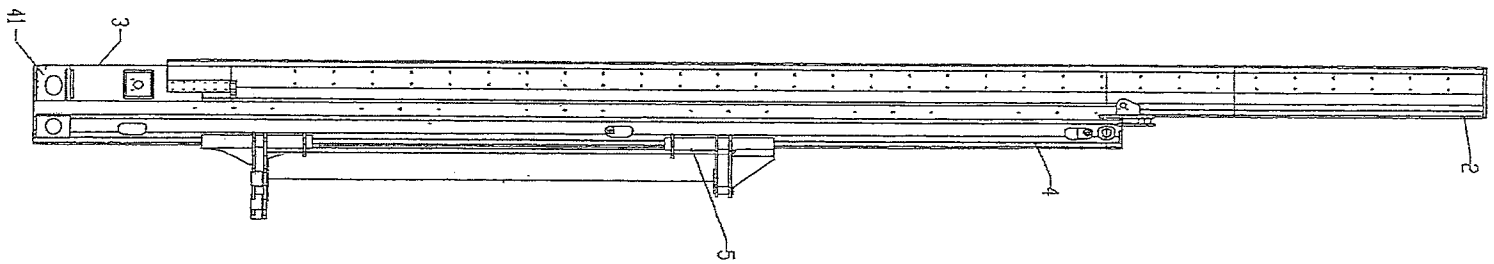
FIG. 3 shows the representation of the telescoping leader from FIG. 1 in a side view.
Figure 4:
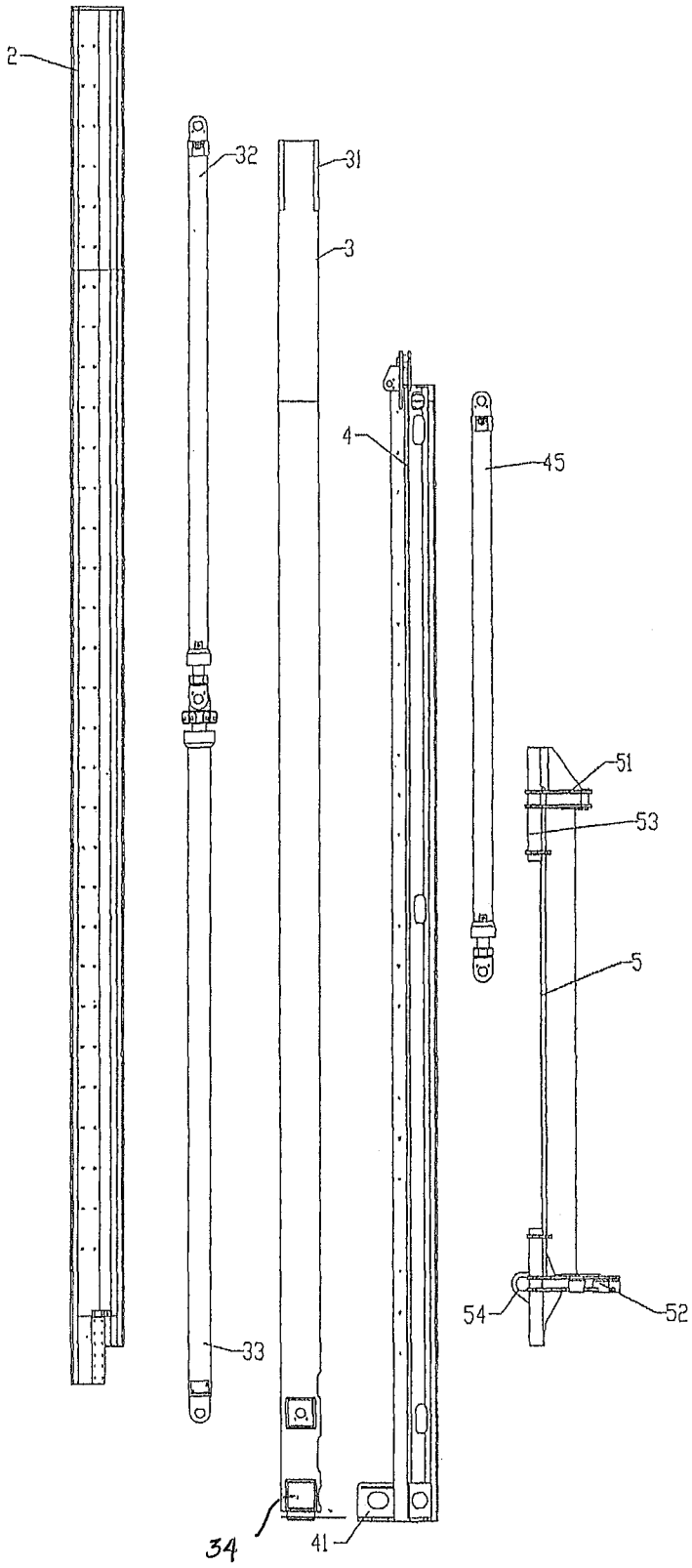
FIG. 4 shows the schematic representation of the telescoping leader from FIG. 1 in an exploded view.

Referring now in detail to the drawings, telescoping leader 1 essentially consists of an outer leader 2 that is guided on an inner leader 3. An intermediate leader 4 is provided, which is connected with inner leader 3 and in which outer leader 2 is displaceably guided. Intermediate leader 4 is connected with a leader connection plate 5, and intermediate leader 4 is displaceably guided on leader connection plate 5.

Outer leader 2 is configured as a profile, preferably composed of bent metal sheets, and has an essentially rectangular cross-section. Along its four corners, two crosspieces 21 are formed onto the outer leader, and two running surfaces 22 that lie opposite one another are delimited by these. On its end facing away from inner leader 3, outer leader 2, which for the remainder is configured as a hollow profile, is closed off with a cover plate 23. At its end that lies opposite cover plate 23, outer leader 2 is provided with a guide 24 on the inside, and this guide lies against inner leader 3.

Inner leader 3 is configured as a hollow cylinder. On its end that faces outer leader 2, a step 31 is formed onto inner leader 3, with which it lies against the inner wall of outer leader 2. Inner leader 3 is thus only guided in outer leader 2 by way of step 31, as well as on the opposite side by way of the inner guide (not shown) of the outer leader 2. Within the inner leader, two hydraulic cylinders 32, 33 are disposed, one behind the other. In this embodiment, hydraulic cylinders 32, 33 each have a lift of 4500 mm. At its end that faces the intermediate leader, lifting cylinder 33 is connected with a support cylinder 34, which is attached to accommodation 41 of intermediate leader 4, on which inner leader 3 rests and with which inner leader 3 is connected. Upper lifting cylinder 32 is connected, on the inside, with outer leader 2 on its side that faces accommodation 41 of intermediate leader 4.

Intermediate leader 4 is configured as a profile, preferably joined together from bent metal sheets. It has an essentially trapezoid cross-section. On its side that faces the outer leader, two guide rails 42 that lie opposite one another are formed on, in which crosspieces 21 of a running surface 22 of the outer leader are guided. Outer leader 2 is therefore guided in the longitudinal direction both by the inner leader and by guide rails 42 of the intermediate leader. On its side that lies opposite accommodations 41, two projecting crosspieces 43 are formed onto intermediate leader 4, lying opposite one another, and these delimit a running surface 44.

It is advantageous if a hydraulic cylinder 45 is furthermore disposed in intermediate leader 4, which is structured as a hollow profile. Cylinder 45 is connected with the intermediate leader at its end that faces accommodation 41, and is connected with leader connection plate 5 at its opposite end. The connection of hydraulic cylinder 45 with leader connection plate 5 takes place by an eye 54 formed onto leader connection plate 5, which eye projects through a guide slit 46 made in running surface 44 of intermediate leader 4.

Figure 5:
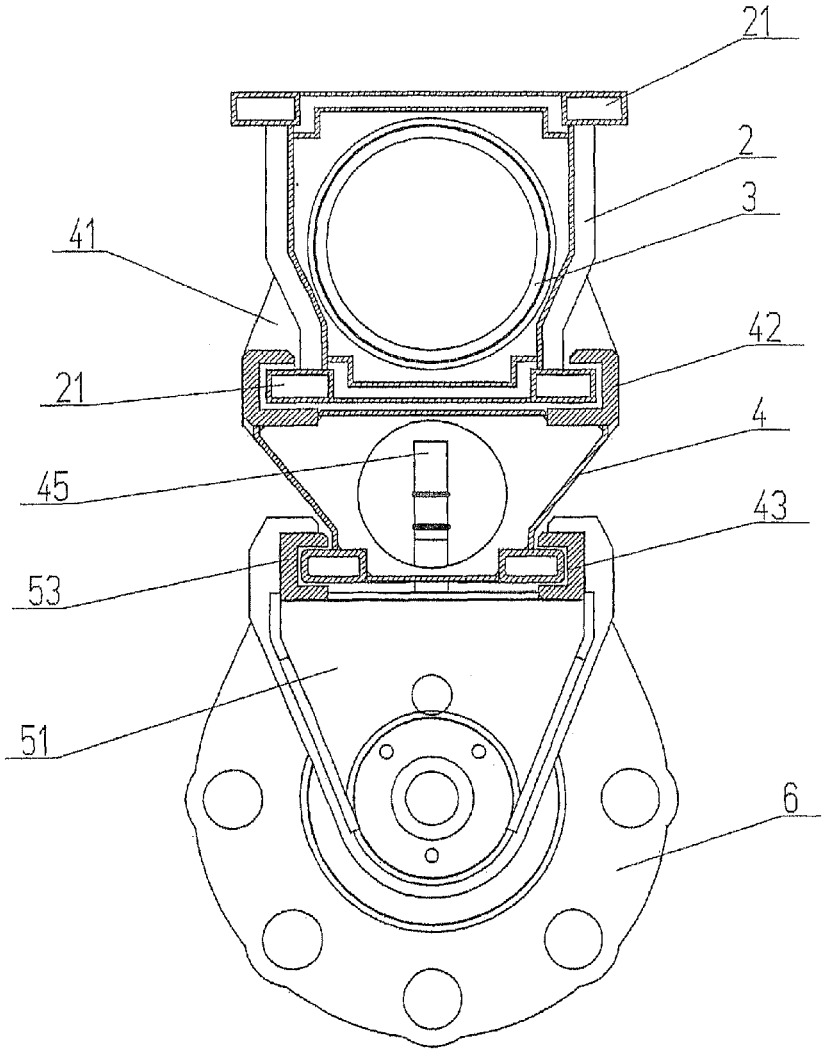
FIG. 5 shows the representation of a telescoping leader in section.

Leader connection plate 5 is configured essentially as an elongated rectangular plate, on which two connection flanges 51, 52 that lie opposite one another are disposed. Guide rails 53 are formed on its side that lies opposite connecting flanges 51, 52. Guide rails 53 are disposed at the height of connecting flanges 51, 52, in sections, in which rails the crosspieces 43 of running surface 44 of intermediate leader 4 are guided. Intermediate leader 4 can be displaced along leader connection plate 5 by way of hydraulic cylinder 45. Leader connection plate 5 connects the telescoping leader to a construction vehicle. In the embodiment according to FIG. 5, a pivot pipe 6 is attached to leader connection plate 5, for pivoting placement of the telescoping leader on a construction vehicle. In order to perform a pivoting movement, pivot pipe 6 is preferably provided with a pivot motor—not shown.

The work device—not shown—is attached to the outer leader by way of an adapter sledge—not shown—whereby the adapter sledge can be moved along crosspieces 21 of outer leader 2. In this connection, the adapter sledge is moved along the running surface 22 of outer leader 2 in known manner, by way of a cable system—not shown.

Accordingly, while only a few embodiments of the present invention have been shown and described, it is obvious that many changes and modifications may be made thereunto without departing from the spirit and scope of the invention.

What is claimed is:

1. A telescoping leader for a construction vehicle, for accommodating a vibrator, pile driver, earth drilling gear mechanism, comprising:

an inner leader having a first end and a second end;

an outer leader surrounding the inner leader and having a first end and a second end, said outer leader being longitudinally displaceable relative to said inner leader, said outer and inner leaders both having closed material cross-sections;

a first guide firmly disposed at the first end of the outer leader, said first end of the outer leader being guided on the inner leader, wherein the inner leader is displaceable in said first guide; and a second guide firmly disposed at an end of the inner leader, said second end of the inner leader being guided in the outer leader, wherein the outer leader is displaceable on said second guide, wherein the inner leader and outer leader are connected with an intermediate leader on which the outer leader is displaceably guided, wherein the inner leader is connected with the intermediate leader via an accommodation of the intermediate leader, wherein the intermediate leader is connected to an exterior surface of the outer leader via guide rails on the intermediate leader; and wherein the outer leader is guided by the inner leader and the intermediate leader at the same time.

2. The telescoping leader according to claim 1, wherein the inner and outer leaders have different material cross-sections or thicknesses in a longitudinal direction.

3. The telescoping leader according to claim 1, further comprising at least one linear drive for displacing the outer leader relative to the inner leader.

4. The telescoping leader according to claim 3, further comprising at least one hydraulic cylinder for displacing the outer leader relative to the inner leader.

5. The telescoping leader according to claim 4, wherein multiple hydraulic cylinders are provided, which have cross-sections that deviate from one another.

6. The telescoping leader according to claim 1, wherein the intermediate leader is connected with a leader connection plate for coupling the telescoping leader with a construction vehicle.

7. The telescoping leader according to claim 6, wherein the intermediate leader is displaceably guided on the leader connection plate.

8. The telescoping leader according to claim 7, further comprising at least one linear drive for displacing the intermediate leader relative to the connection plate.

9. A construction vehicle having a telescoping leader that comprises:

an inner leader having a first end and a second end;

an outer leader surrounding the inner leader and having a first end and a second end, said outer leader being longitudinally displaceable relative to said inner leader, said outer and inner leaders both having closed material cross-sections;

a first guide firmly disposed at an end of the outer leader, said first end of the outer leader being guided on the inner leader, wherein the inner leader is displaceable in said first guide; and a second guide firmly disposed at the second of the inner leader, said second end of the inner leader being guided in the outer leader, wherein the outer leader is displaceable on said second guide, wherein the inner leader and outer leader are connected with an intermediate leader on which the outer leader is displaceably guided, wherein the inner leader is firmly connected with the intermediate leader via an accommodation on the intermediate leader, wherein the intermediate leader is connected to an exterior surface of the outer leader via guide rails on the intermediate leader; and wherein the outer leader is guided by the inner leader and the intermediate leader at the same time.

* * * * *